United States Patent [19]

Baker

[11] Patent Number: 4,559,114

[45] Date of Patent: Dec. 17, 1985

[54] NICKEL SULFATE COLORING PROCESS FOR ANODIZED ALUMINUM

[75] Inventor: Bernard R. Baker, Pleasanton, Calif.

[73] Assignee: Kaiser Aluminum & Chemical Corporation, Oakland, Calif.

[21] Appl. No.: 670,851

[22] Filed: Nov. 13, 1984

[51] Int. Cl.[4] ..... C25C 11/22

[52] U.S. Cl. ..... 204/37.6; 204/58

[58] Field of Search ..... 204/37.6, 58

[56] References Cited

U.S. PATENT DOCUMENTS

| | | | |
|---|---|---|---|
| 4,021,315 | 5/1977 | Yanagida et al. | 204/37.6 |
| 4,022,671 | 5/1977 | Asada | 204/37.6 |
| 4,024,039 | 5/1977 | Yoshida et al. | 204/37.6 |

*Primary Examiner*—R. L. Andrews

*Attorney, Agent, or Firm*—Andrew E. Barlay

[57] ABSTRACT

Anodized aluminum-based metal workpieces are colored in a nickel-based electrolytic coloring process in which the nickel ion is supplied in the form of nickel sulfate in acidic solution. Improvements in both throwing power and coloring rate are observed at elevated temperatures and nickel concentrations.

7 Claims, No Drawings

NICKEL SULFATE COLORING PROCESS FOR ANODIZED ALUMINUM

BACKGROUND OF THE INVENTION

This invention relates to electrolytic coloring processes for anodized aluminum surfaces.

The process of coloring an aluminum or aluminum alloy workpiece by electrolytic means has been widely used and described in the literature, which discloses the basic process as well as numerous variations in both materials and operating conditions. The most common procedures are done subsequent to anodization and involve the use of one or more nickel salts in an acidic electrolyte solution using alternating current. The most common nickel salts are nickel sulfate, acetate, and chloride.

In spite of the long history and wide use of this process, the mechanism by which coloring is achieved is not well understood. Until recently, for example, both the nickel salt concentration and the operating temperature were maintained at low levels, since no benefit was known to occur at higher levels to justify the increased cost, and the higher levels were thought to be detrimental to the throwing power of the bath, i.e., its ability to produce a uniform color over the entire surface of the workpiece. A way of improving the throwing power is reported in commonly assigned U.S. Pat. No. 4,431,489 (Baker et al., Feb. 14, 1984), whereby nickel sulfamate is used as the predominant nickel component of the bath.

SUMMARY OF THE INVENTION

It has now been discovered that nickel sulfate itself is a highly effective coloring agent, particularly when used as the sole salt in an acidic electrolyte solution, without being supplemented by magnesium or ammonium salts. It has further been discovered that nickel sulfate may be used in concentrations and temperatures substantially higher than those cited in the prior art, with substantially no loss of effectiveness in terms of either deposition rate or throwing power. In fact, nickel sulfate has been found to demonstrate an unusual property in terms of its temperature/concentration behavior. Whereas at ambient temperatures (the temperatures used in prior art processes), the amount of nickel deposited in the oxide film formed during anodization is independent of the bath nickel concentration, the same is not true at elevated temperatures. Indeed, at temperatures in excess of about 30° C., a concentration dependency exists, with the result that an increased bath concentration gives an increased rate of deposition. Further, at elevated temperatures, the throwing power shows a concentration dependency as well, increasing with increasing concentration.

DESCRIPTION OF THE PREFERRED EMBODIMENTS

In accordance with the present invention, an aluminum-based metal workpiece, after being anodized, is mounted as an electrode in an electrolysis bath, the bath consisting of an acidic aqueous solution of nickel sulfate at a concentration of at least about 30 grams (expressed as nickel ion) per liter of solution. Coloring is then achieved by passing an alternating current between the workpiece and at least one counter electrode while the bath is at a temperature of at least about 30° C., until the desired degree of coloring is achieved. Benefits in coloring rate and uniformity of color are attainable within these conditions.

While the unusual results of the present invention are observable at temperatures in excess of about 30° C., it is generally preferable to operate in the range of about 30° C. to about 80° C., with temperatures ranging from about 40° C. to about 65° C. particularly preferred. Similarly, beneficial results in terms of the nickel concentration are observable at levels above about 30 grams of nickel per liter of solution. The preferred operating range is from about 40 grams per liter to about 100 grams per liter.

The nickel sulfate is the primary source of nickel ion in the coloring bath, preferably the sole source. The nickel sulfate may be either added directly or generated in situ by combining another nickel salt, such as nickel carbonate, with sulfuric acid. In preferred embodiments, nickel sulfate is the only nickel salt used in the bath.

The actual pH is not critical provided that it is in the acid range. In most applications, a pH ranging from about 2.0 to about 5.5 will provide the best results. In preferred systems, the pH ranges from about 4.0 to about 5.0, and in particularly preferred systems, the pH ranges from about 4.3 to about 4.4. The acidity is achieved by the inclusion of boric acid in the bath, which functions as a buffer as well, unless sulfuric acid is present to provide sulfate ion as indicated above.

The applied current is an alternating current, preferably voltage controlled at an operating voltage of about 5 to about 40 volts (AC), most preferably from about 6 to about 15 volts (AC). A convenient method of operation is to gradually raise the voltage of the cell to the desired operating level and maintain it at that level until the desired color is achieved. The counter electrode may be any inert, electrically conducting material. Examples include nickel, stainless steel, and graphite.

The process of the present invention is applicable to a wide range of aluminum-based metal products, including aluminum and its many alloys. Notable alloys to which the process may be applied are those of the 5XXX, 6XXX and 7XXX series according to the Aluminum Association Alloy designations. Examples include those alloys designated 5052, 5205, 5657, 6063 and 7029.

The anodizing step which precedes the coloring step may be achieved according to conventional methods. In general, this is done by direct current electrolysis of the workpiece through an aqueous electrolyte. Examples of suitable electrolytes are chromic, sulfuric, oxalic, sulfamic and phosphoric acids, as well as borates, citrates, and carbonates. Aqueous solutions of sulfuric acid ranging in concentration from about 7% to about 30% by weight are preferred. While the thickness of the resulting oxide coating is not critical and may be widely varied, in most applications a thickness of at least about 0.1 mil (2.5 microns), preferably at least about 0.75 mil (19 microns), will provide the best results.

The electrolytic coloring procedure is preferably done soon after the anodization. The coloring may then be followed by a sealing treatment, according to any of the methods known in the art. Exemplary such methods include immersing the workpiece in boiling water or a hot solution of nickel acetate.

The following examples are offered for purposes of illustration, and are intended neither to define nor limit the invention in any manner.

EXAMPLE 1

Nickel Deposition Rate Tests

Sheets of 5205 aluminum alloy each measuring 2.75 by 8.5 inches (7 by 21.6 cm, with 302 $cm^2$ surface area) were anodized singly in a 165 g/liter sulfuric acid solution at 16 volts and 22.0° C. to an oxide thickness of 0.4 mil (10 microns). Coloring was then effected in one of several nickel sulfate baths at varying nickel sulfate concentrations and bath temperatures, each bath containing 35 g/liter boric acid at a pH of 4.3–4.4 and an impressed voltage of 14 volts AC (RMS) for ten minutes (maximum voltage reached in about 6 seconds each time), using two stainless steel counter electrodes. The nickel content in each sample was then measured by x-ray spectroscopy. The results are shown in Table 1, where the bath nickel content is expressed as nickel ion rather than nickel sulfate.

TABLE 1

NICKEL DEPOSITION AS FUNCTION OF BATH NICKEL CONCENTRATION AND TEMPERATURE

| Bath Temperature (°C.) | Nickel Content of Oxide Layer ($mg/cm^2$) Bath Nickel Concentration (g/l): 23.8 | 32.6 | 44.2 | 64.2 | 88.6 |
|---|---|---|---|---|---|
| 25.0 | 0.094 | 0.100 | 0.118 | 0.114 | 0.102 |
| 30.0 | 0.106 | 0.127 | 0.130 | 0.131 | 0.156 |
| 35.0 | 0.117 | 0.138 | 0.155 | 0.170 | 0.172 |
| 40.0 | 0.129 | 0.146 | 0.162 | 0.177 | 0.192 |
| 45.0 | 0.141 | 0.151 | 0.158 | 0.173 | 0.194 |
| 50.0 | 0.131 | 0.138 | 0.153 | 0.171 | 0.198 |

This data demonstrates a marked advantage in operating the coloring process at an elevated temperature: the nickel content of the oxide coating increases with increasing nickel in the bath at temperatures of 30° C. and above, the rate of increase being even more dramatic at 40° C. and above. The data at 25° C., by contrast, shows an initial increase followed by a leveling off at bath nickel concentrations above about 44 g/l.

EXAMPLE 2

Nickel Throwing Power Tests

Aluminum sheets identical to those described in Example 1 were anodized under the same conditions, except using two sheets at a time with an open configuration to ensure a uniform oxide thickness. After anodizing, the sheets were rearranged so that they were parallel to each other with a 1-cm separation, and mounted in the nickel sulfate bath perpendicular to one of the counter electrodes, the other counter electrode having been disconnected. Using a temperature of 50° C. and varying nickel contents in the bath, the sheets were colored for three minutes at 14 volts AC (RMS).

The nickel content in each sample was measured by x-ray spectroscopy as before, on 3.1-cm diameter circles at four points, the centers of which were 1.5, 7.5, 14 and 20 cm from the end closest to the active counter electrode. The measurements were made on the outside face of the workpiece only. The results are shown in Table 2, where the bath nickel content is again expressed as nickel ion rather than nickel sulfate.

TABLE 2

THROWING POWER TESTS

| Bath Nickel Concentration (g/liter) | Nickel Content of Oxide Layer ($mg/cm^2$) Distance from end of strip nearest counter electrode (cm): 1.5 | 7.5 | 14.0 | 20.0 |
|---|---|---|---|---|
| 23.8 | 0.081 | 0.037 | 0.025 | 0.022 |
| 32.6 | 0.084 | 0.039 | 0.029 | 0.025 |
| 44.2 | 0.078 | 0.042 | 0.032 | 0.030 |
| 64.2 | 0.087 | 0.050 | 0.039 | 0.037 |
| 88.6 | 0.087 | 0.051 | 0.041 | 0.039 |

By comparing the drop in nickel content from the 1.5 cm location to the 20.0 cm location, it is apparent that the drop was almost halved (i.e., the throwing power doubled) as the bath nickel concentration rose from 23.8 g/liter to 88.6 g/liter.

The foregoing description is offered primarily for illustrative purposes. It will be readily apparent to those skilled in the art that the particular materials and procedures described herein may be further varied or modified in numerous ways without departing from the spirit and scope of the invention as set forth in the following claims.

What is claimed is:

1. A method of coloring an anodized aluminum-based metal workpiece comprising passing an alternating current through an aqueous acidic nickel sulfate electrolyte between said workpiece and a counter electrode, both of which are submerged therein, maintaining the electrolyte at a temperature during the coloring within the range from about 30° C. to about 80° C., at a pH within the range from about 2.0 to about 5.5 at a nickel sulfate concentration from about 40 to about 100 grams per liter expressed as Nig/e and controlling the current during the coloring at an operating voltage of from about 5 to about 40 volts.

2. A method in accordance with claim 1 in which said temperature is from about 40° C. to about 65° C.

3. A method in accordance with claim 1 in which the pH of said solution is from about 4.0 to about 5.0.

4. A method in accordance with claim 1 in which said acidic aqueous solution is a boric acid solution.

5. A method in accordance with claim 1 in which said nickel sulfate concentration is from about 40 to about 100 grams of nickel per liter of solution, said temperature is from about 40° C. to about 65° C., said pH is from about 4.0 to about 5.0, and said acidic aqueous solution is a boric acid solution.

6. A method in accordance with claim 1 in which said current is voltage controlled at an operating voltage of from about 6 to about 15 volts AC.

7. A method of coloring an aluminum-based metal workpiece comprising:

(a) anodizing said workpiece in an aqueous sulfuric acid solution at a concentration of from about 7% to about 30% by weight, by direct current, to form an oxide layer of at least about 0.75 mil thickness on the surface thereof;

(b) connecting said anodized workpiece and a counter electrode in an alternating current electrolysis circuit passing through an acidic aqueous solution consisting essentially of nickel sulfate at a concentration of from about 40 to about 100 grams of nickel per liter of solution and boric acid at a pH of from about 4.0 to about 5.0; and (c) passing a voltage-controlled alternating current through said solution between said workpiece and counter electrode at a voltage of from about 6 to about 15 volts (AC) and a temperature of from about 40° C. to about 65° C.

* * * * *